United States Patent [19]

Girard

[11] 4,055,965

[45] Nov. 1, 1977

[54] HEAT PUMP INSTALLATION

[75] Inventor: Edmond Girard, Boulogne, France

[73] Assignee: Society Messier, Paris, France

[21] Appl. No.: 721,588

[22] Filed: Sept. 8, 1976

[51] Int. Cl.[2] ..... F25B 13/00; F25B 1/10

[52] U.S. Cl. ..... 62/324; 62/510

[58] Field of Search ..... 62/510, 324, 196 A, 62/338, 160; 165/62

[56] References Cited

U.S. PATENT DOCUMENTS

| | | | |
|---|---|---|---|
| 2,751,761 | 6/1956 | Borgerd | 62/324 |
| 3,631,873 | 1/1972 | Swithenbank et al. | 62/324 |
| 3,721,097 | 3/1973 | Briley et al. | 62/510 |
| 3,750,415 | 8/1973 | Peuchen et al. | 62/324 |
| 3,959,986 | 6/1976 | Ledermann | 62/324 |
| 3,995,809 | 12/1976 | Karlsson | 62/324 |

*Primary Examiner*—Lloyd L. King

[57] ABSTRACT

A pump installation has a first heat exchanger for heating a fluid, a compressor unit connected to the first exchanger and having static mechanical means for pre-compression and temperature increase of the fluid, a motor-driven compressor connected to the compressor unit, for compressing the fluid, and a second heat exchanger for passing heat from the fluid to a working circuit fluid. A first valve passes fluid from the outlet of the compressor to the second exchanger selectively directly or indirectly through the compressor unit, and a second valve passes fluid from the outlet of the second exchanger to an expansion means for feeding the fluid back to the first exchanger selectively directly or indirectly through the compressor unit. The hot fluid feedback to the compressor unit from the compressor or the second exchanger produces the temperature rise in the fluid passing through the compressor unit, actuation of the valves between their respective positions producing different levels of heat output in relation to heating demand.

10 Claims, 1 Drawing Figure

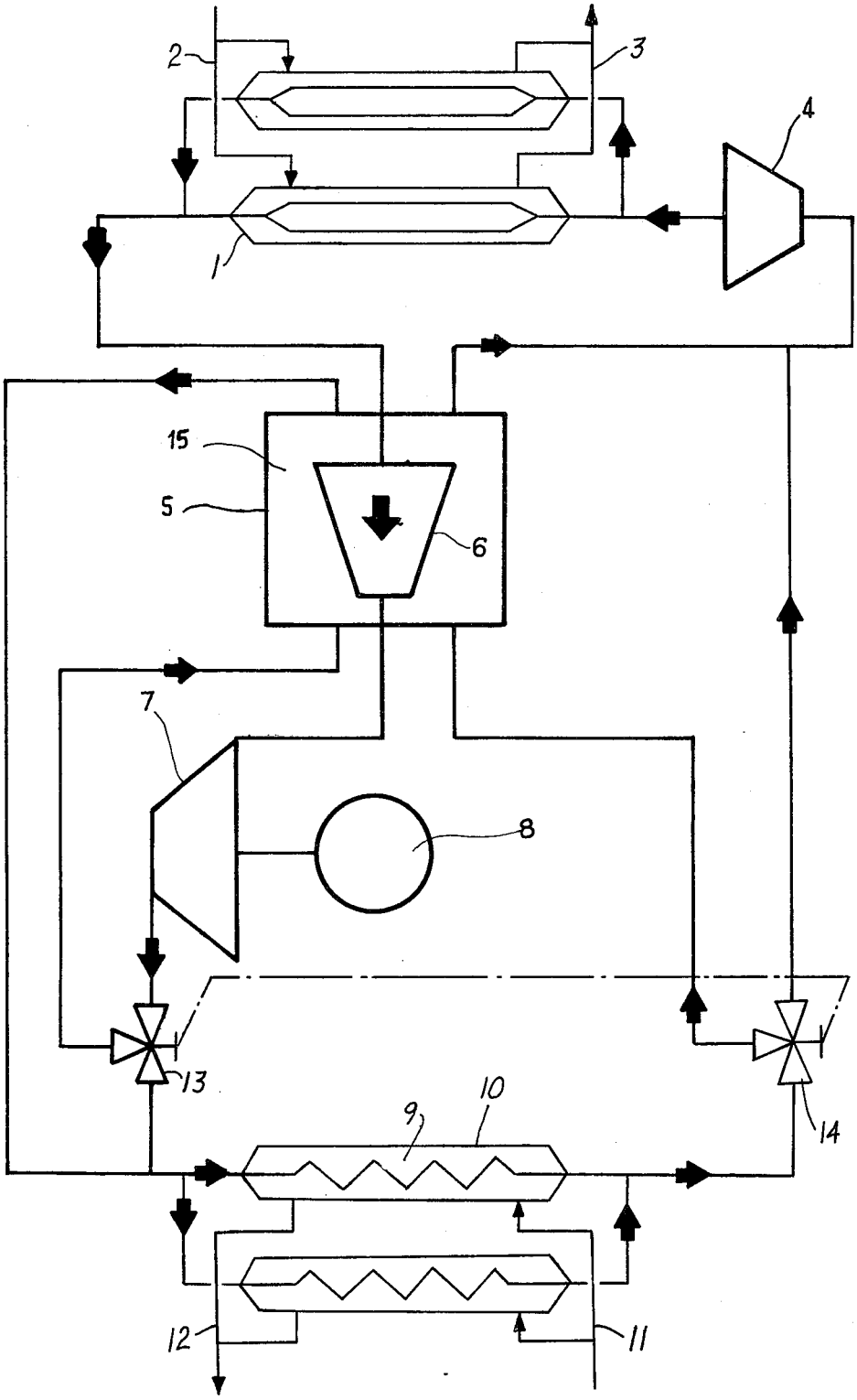
2
3
4
1
15
5
6
7
8
13
14
9
10
12
11

HEAT PUMP INSTALLATION

BACKGROUND OF THE INVENTION

Refrigerating circuits, often called heat pumps, are being more and more widely used in systems for exploiting and utilising the heat energy contained in any heat accumulator or generator, for example the heat energy of the outside air or the hot cooling air discharged for example from areas in which machines such as computers give off heat, or the heat energy of any group of natural elements such as the water of phreatic deposits and the ground (geothermic sources) and whose thermal properties render use thereof attractive, insofar as the heat energy contained in the cooling circuit of the heat source can be employed in an installation for heating and/or air-conditioning for example industrial or private premises.

In such systems, the source is often assimilated to an indirect-use heat source by means of an exchanger, for example for heating the water of a hot water production circuit of a building, or a central heating circuit.

The present invention relates to a heat pump installation, for example of the compression type, such as those which are used alone or in combination with a supplementary boiler in such installations.

The known heat pumps, which extract heat energy from the cooling of a source of heat, and transmit the extracted heat to a working fluid which then carries the heat into the premises to be heated, are conventionally thermally coupled to the cooling circuit of the source by means of a first heat exchanger in which a cooling fluid circulated by the pump absorbs the excess heat carried by the heat-carrying fluid coming from the cooling circuit of the source, said heat being restored to the working circuit such as a central heating circuit, by means of at least one second heat exchanger. Such a heat pump of the compression type comprises a compressor assembly which transmits the cooling fluid to a condenser, for liberating the heat energy to the working circuit by way of the second heat exchanger or exchangers. At the outlet from the second heat exchanger or exchangers, the condensed cooling fluid passes into a third heat exchanger in which it gives off more heat, and then into a dehydrater in order finally to finish at an expansion means. After having passed through the expansion means, the cooling fluid is converted into the gaseous state, insofar as, in the first heat exchanger, it absorbs heat from the heat-carrying fluid circulating in the cooling circuit of the source. The cooling fluid coming from the first heat exchanger is then superheated when it passes into the third heat exchanger, and is then transmitted to the compressor assembly.

SUMMARY OF THE INVENTION

An object of the present invention is to provide a heat pump installation which has an improved amplification coefficient in respect of the temperature increase of the working fluid. A further object of the invention is to achieve very substantial economies in consumption in driving the compressor assembly which, in the present state of the art, consume substantial amounts of energy.

According to the invention, a pump installation comprises a series circuit of at least one first heat exchanger, a compressor or compressor assembly, at least one second heat exchanger, and an expansion means. The first heat exchanger, or a heat exchanger assembly formed by the first exchangers connected for example in parallel, is connected to the compressor or compressor assembly by way of a stato-thermic compressor. The second exchanger, or a heat exchange assembly formed by the second exchangers connected for example in parallel, is connected to the expansion means also by way of the stato-thermic compressor. At the outlet from the compressor or compressor assembly is a first three-way valve for diverting the cooling fluid from the compressor or compressor assembly alternatively into the stato-thermic compressor and then into the second heat exchanger or directly into the second heat exchanger. At the outlet from the second heat exchanger is a second three-way valve for diverting the cooling fluid alternatively into the stato-thermic compressor and then to the expansion means, or directly into the expansion means. The stato-thermic compressor may comprise static mechanical means for effecting pre-compression of the cooling fluid before entry to the compressor or compressor assembly and, simultaneously, the stato-thermic compressor causes an increase in the temperature of the cooling fluid by the absorption of heat from the cooling fluid which issues from the first valve or from the second valve according to the respective positions thereof.

In normal operation, that is to say, when the working circuit takes all the heat from the heat-carrying fluid coming from the compressor or compressor assembly, the first three-way valve is in a position in which all the said fluid is directed towards the second heat exchanger or exchangers and the second three-way valve is in a position in which all the said fluid is returned to the expansion means via the stato-thermic compressor. However, when the temperatures at the level of the second heat exchanger or exchangers can be lower, by virtue of a smaller demand for heating of the heat-exchange fluid of the working circuit, more substantial economies in consumption can be achieved by causing the fluid to be directed, by the first valve, first into the stato-thermic compressor and then into the second heat exchanger and by placing the second valve in a position for directing the said fluid directly into the expansion means.

In a preferred embodiment of the invention, the stato-thermic compressor comprises purely mechanical static means which, solely by their presence and structure, achieve the double function of pre-compression and temperature elevation of the cooling fluid passed to the compressor or compressor assembly. In this preferred embodiment, these static mechanical means comprising an exchanger-superheater whose conduit carrying the cooling fluid to the compressor is provided with a convergent means for effecting said pre-compression action.

In a preferred embodiment of the invention, the two three-way valves are coupled by an actuating device providing for simultaneous actuation thereof.

BRIEF DESCRIPTION OF THE DRAWINGS

The single FIGURE of the drawing shows an embodiment of the invention.

DESCRIPTION OF THE EMBODIMENT

The pump installation shown comprises a first heat exchanger or evaporator 1 having an inlet 2 for a heat-carrying fluid from the cooling circuit of a cold source (for example the water of a hydraulic circuit operating in a closed or semi-closed loop, providing for the combination of the natural elements forming said cold source of the thermopump, said water being for example at the temperature of the waters of the shallow subsoil). The heat exchanger 1 also has an outlet 3 for the return of the heat-carrying fluid to the cold source, after having given up heat to a heat-exchange or cooling fluid (which can be for example a freon such as that known under the designation "R 22"), hereinafter referred to as the cooling fluid, which flows into the heat exchanger 1 from an expansion means 4 and which is vaporised by absorbing heat from the heat-carrying fluid entering at 2.

The installation may have a plurality of first heat exchangers as at 1, which are connected for example in parallel with each other.

The cooling fluid is at a temperature for example of −7° C at the outlet from the expansion means 4, and is at a pressure of 5 bars and a temperature of +7° C at the outlet from the heat exchanger 1. The cooling fluid is then passed to a stato-thermic compressor which in a preferred form comprises purely mechanical static means which, solely by their presence and structure achieve a double function of pre-compression and temperature increase of the cooling fluid, as will be described below. Thus, the stato-thermic compressor comprises an exchanger-superheater having an outside chamber 5 housing a conduit or flow member 6 of frustoconical configuration forming a convergent means. The term convergent means denotes any flow means whose flow section decreases in the direction of displacement of the fluid, to effect the pre-compression action. The longitudinal configuration of the convergent means can be a generally tapered portion, for example defined by a portion of a parabola or a hyperbola, while in a very simple construction as illustrated, the convergent means is in the form of a frustoconical flow member. The effect of the convergent means or flow member 6 is to convert the heat which is absorbed by the cooling fluid in the heat exchanger, and a part of the speed of circulation of the cooling fluid, into pressure, and the cooling fluid leaves the compressor at a pressure which is substantially greater than the input value. The cooling fluid also undergoes a rise in temperature which is essentially due to the transfer of heat from the compressed cooling fluid which is circulating, in a manner that will be described below, in a conduit 15 defined between the flow member 6 and the outside wall of the chamber 5, to the cooling fluid as it flows to a compressor 7 for compression therein; this heat exchange takes place through the walls of the flow member 6 which is accordingly formed of a material which encourages such heat exchanges, and which can carry radiation vanes to promote heat exchange efficiency. The compressor 7 is driven by a motor 8.

At the outlet from the compressor 7 there is a three-way valve 13 which receives the hot, compressed cooling fluid from the compressor 7 and directs the cooling fluid either: (a) directly to a condenser 9 where the cooling fluid gives off heat to a central heating system by way of a second heat exchanger or condenser 10 which has an inlet 11 for the heat-exchange working fluid from the central heating circuit and an outlet 12 for carrying the heated central-heating circuit fluid to the areas to be heated; or (b) to the compressor 5, 6, 15 where the cooling fluid passes through the conduit 15 and is then passed to the second exchanger 10. As the cooling fluid passes through the conduit 15, it does of course provide for the transfer of heat through the flow member 6 to the cooling fluid flowing in the flow member 6, as described above.

The condenser 9 may comprise a plurality of heat exchangers connected for example in parallel with each other.

Similarly, a second three-way valve 14 is provided at the outlet of the heat exchanger 10, for directing the now condensed cooling fluid either: (a) to the conduit 15 and then to the expansion means 4; or (b) directly to the expansion means 4. In both cases, the expansion means 4 receives the cooling fluid at a pressure of about 29 bars and a temperature of about 40° C, and returns it to the first heat exchanger 1 at a temperature of −7° C.

The two valves 13 and 14 are coupled by an actuating device which makes it possible for them to be actuated simultaneously in such a way that when the valve 13 directly connects the compressor 7 to the second heat exchanger 10, the valve 14 directs the cooling fluid to the conduit 15 of the compressor 5, 6, 15, this assembly thus forming a primary circuit or flow path; and when the valve 13 directs the compressed cooling fluid to the conduit 15 of the compressor 5, 6, 15, the valve 14 connects the second heat exchanger 10 directly to the expansion means 4, this assembly thus forming a secondary circuit or flow path.

When the cooling fluid passes through the above-defined primary circuit or flow path, the fluid flowing through the flow member 6 leaves the compressor 5, 6, 15 at a pressure of 11 bars and a temperature of 30° C, the increase in temperature being essentially due to the transfer of heat coming from the hot cooling fluid passing through the conduit 15 as it returns to the expansion means 4. The cooling fluid, which is raised to a pressure of 29 bars and a temperature of 70° C by the compressor 7 is transmitted to the second heat exchanger 10 which it leaves at a pressure of about 29 bars and a temperature of 50° C, passing through the conduit 15 and arriving at the inlet of the expansion means 4 at a temperature of 40° C.

On the other hand, when the cooling fluid passes through the above-defined secondary circuit or flow path, the fluid flowing through the flow member 6 leaves the compressor 5, 6, 15 at a pressure of about 15 bars and at a temperature approaching 40° C, due to a transfer of heat which is more substantial than that just described above, since such transfer comes from the cooling fluid which has been compressed in the compressor 7 to a pressure of 29 bars and which is at a temperature of 70° C and which is passed directly to the conduit 15 on issuing from the compressor 7; it is essential that the pressure at the outlet of the compressor is 29 bars, in the example illustrated, to provide for good operation of the heat pump circuit.

Having passed through the conduit 15 in the secondary circuit or flow path, the compressed cooling fluid is passed at a temperature of 60° C to the second heat exchanger 10 from which it issues at a temperature of 40° C, then being passed directly to the expansion means 4.

In a conventional heat pump installation, comprising a simple third exchanger or superheater instead and in place of the above-described compressor 5, 6, 15 the pressure of the cooling fluid would be established at an intermediate value, of about 5 or 6 bars, taking the numerical pressure and temperature values given hereinbefore by way of example. The consequence of this is that the compressor of the conventional installation (corresponding to compressor 7 of the embodiment described herein) must increase the pressure of the fluid by 24 bars, whereas, as the primary circuit or flow path of the embodiment described and illustrated is a loop-circuit (from compressor 7, through valve 13 and exchanger 10 to the conduit 15), the compressor 7 is required to raise the pressure of the fluid by 18 bars, the temperature being respectively 70° C and 50° C at the inlet into and at the outlet from the second heat exchanger 10. As the secondary circuit or flow path is also a loop circuit (from compressor 7 through valve 13 and conduit 15 to heat exchanger 10), these same parameters have the values of 14 bars, 60° C and 40° C.

In a manner known per se, the circulation of the fluid which provides heat is in the opposite direction to the direction of circulation of the fluid which receives heat in the first and second exchangers 1 and 10 and in the stato-thermic compressor 5, 6, 15.

The above-described embodiment of the invention can advantageously be provided, between the compressor 5, 6, 15 and the expansion means 4, with a dehydrator, a liquid sighting means and a solenoid valve.

It will be appreciated that regulation of the pump installation can be effected by a plurality of known means, in which case the installation then becomes an auto-thermogenous pump. For example, the speed of rotation of the motor 8 of the compressor 7 can be controlled by any suitable regulator in dependence on the condition of the cooling fluid at the outlet from the condenser 9, this condition being detected by means of a probe or suitable sensing device.

It will be seen therefore that in normal operation, that is to say, when the working circuit at 11, 12 takes all the heat from the cooling fluid coming from the compressor or compressor assembly 7, the first three-way valve 13 is in a position in which all the cooling fluid is directed towards the second heat exchanger or exchangers 10 and the second three-way valve 14 is in a position in which all the cooling fluid is returned to the expansion means 4 via the stato-thermic compressor 5, 6, 15. However, when the temperatures at the level of the second heat exchanger or exchangers 10 can be lower, by virtue of a smaller demand for heating of the heat-carrying fluid of the working circuit 11, 12, more substantial economies in consumption can be achieved by causing the cooling fluid to be directed, by the first valve 13, first into the stato-thermic compressor 5, 6, 15 and then into the second heat exchanger 10 and by placing the second valve 14 in a position for directing and cooling fluid directly into the expansion means 4.

The advantages achieved by the above-described embodiment of the invention are therefore an increase in the amplification coefficient, and the very substantial economies achieved in regard to the motor 8 driving the compressor 7. In addition however, supplementary economies will be achieved at the motor 8 driving the compressor 7, when the requirements of the working circuit can be satisfied with the inlet and outlet temperatures obtaining at the second exchanger, by making the secondary circuit a loop circuit.

Various modifications can of course be made without thereby departing from the scope of the present invention as defined by the appended claims.

I claim:

1. A heat pump installation comprising: at least one first heat exchanger in which a heat-exchange fluid of the installation absorbs heat from a heat-carrying fluid; a stato-thermic compressor comprising static mechanical means for effecting pre-compression and temperature elevation of the heat-exchange fluid, connected to the heat-exchange fluid outlet of the first heat exchanger; a compressor means connected to the outlet of the stato-thermic compressor, for compression of the heat-exchange fluid issuing therefrom; a second heat exchanger in which the heat-exchange fluid transfers heat to a working circuit which, in use, is connected to the installation; an expansion means connected to the heat-exchange fluid outlet on the second heat exchanger, for return of the fluid to the first heat exchanger; a first three-way valve in the connection between the outlet of the compressor means and the second heat exchanger, for diverting heat-exchange fluid from the compressor means to the second heat exchanger indirectly through the stato-thermic compressor; and a second three-way valve in the connection between the heat-exchange fluid outlet of the second heat exchanger and the expansion means, for diverting the heat-exchange fluid from the second heat exchanger to the expansion means indirectly through the stato-thermic compressor whereby the stato-thermic compressor effects pre-compression of the heat-exchange fluid before said fluid enters the compressor means and at the same time an increase in the temperature of said fluid by the absorption of heat from the heat-exchange fluid issuing alternatively from the compressor means on route to the second heat exchanger and from the second heat exchanger on route to the expansion means.

2. A heat pump installation comprising; a first heat exchange means to transfer heat to a heat-exchange fluid of the installation from a hot fluid coming from a heat source; a compressor means for compressing the heat-exchange fluid; a second heat exchange means to transfer heat from the heat-exchange fluid to the fluid of a working circuit which in use is connected to the installation; an expansion means for return of the heat-exchange fluid from the second heat exchange means as to the first heat exchange means; a stato-thermic compressor comprising static mechanical means, operable to effect pre-compression and temperature elevation of the heat-exchange fluid; means connecting the heat exchange fluid outlet of the first heat exchange means to the inlet of the stato-thermic compressor; means connecting the heat exchange fluid outlet of the stato-thermic compressor to the inlet of the compressor means; a first three-way valve having one way connected to the outlet of the compressor means, a second way connected to the heat-exchange fluid inlet of the second heat exchange means, and a third way connected through the stato-thermic compressor to the heat-exchange fluid inlet of the second heat exchange means, the first valve having a first position in which fluid from the compressor is passed directly to the second heat exchange means and a second position in which fluid from the compressor is passed through the stato-thermic compressor and then to the second heat exchange means; a second three-way valve having a first way connected to the heat-exchange fluid outlet of the second heat exchange means, a second way connected to the inlet of the expansion means, and a third way connected through the stato-thermic compressor to the inlet of the expansion means, the second valve having a first position in which fluid from the second heat exchange means is passed through the stato-thermic compressor and then to the expansion means and a second position in which fluid from the second heat exchange means is passed directly to the expansion means, the stato-thermic compressor thereby being effective to effect pre-compression of the heat-exchange fluid before said fluid passes into the compressor means and simultaneously an increase in the temperature of said fluid by the absorption of heat from the fluid passing through the stato-thermic compressor from either one of the first and second valves.

3. An installation according to claim 2 wherein said first heat exchange means comprises a plurality of exchangers connected in parallel with each other.

4. An installation according to claim 2 wherein said second heat exchange means comprises a plurality of heat exchangers connected in parallel with each other.

5. An installation according to claim 2 wherein said static mechanical means comprises an exchanger-superheater having a conduit for carrying the heat exchange fluid to the compressor means, said conduit having a convergent means for effecting said pre-compression.

6. An installation according to claim 5 wherein said convergent means is a flow member having a generally tapered flow section.

7. An installation according to claim 6 wherein said flow cross-section is a portion of a parabola.

8. An installation according to claim 6 wherein said flow section is a portion of a hyperbola.

9. An installation according to claim 6 wherein the convergent means is a frustoconical flow member.

10. An installation according to claim 2 including an actuating device for simultaneous actuation of said two valves.

* * * * *